United States Patent [19]

Fitts

[11] Patent Number: 4,682,021

[45] Date of Patent: Jul. 21, 1987

[54] HEADER ASSEMBLY FOR AN INTENSIFIED CHARGE COUPLED IMAGE SENSOR

[75] Inventor: Robert W. Fitts, Lititz, Pa.

[73] Assignee: RCA Corporation, Princeton, N.J.

[21] Appl. No.: 823,536

[22] Filed: Jan. 29, 1986

[51] Int. Cl.[4] ..... H01J 31/50

[52] U.S. Cl. ..... 250/213 VT; 313/523

[58] Field of Search ..... 250/213 R, 213 VT, 207; 313/523, 528, 531, 532, 540, 553

[56] References Cited

U.S. PATENT DOCUMENTS

| | | | |
|---|---|---|---|
| 3,290,171 | 12/1966 | Zollman et al. . | |
| 3,658,400 | 4/1972 | Helvy . | |
| 4,355,229 | 10/1982 | Zimmerman et al. | 250/213 VT |
| 4,633,076 | 12/1986 | Butterwick | 250/213 VT |

*Primary Examiner*—Edward P. Westin

*Attorney, Agent, or Firm*—Eugene M. Whitacre; Dennis H. Irlbeck; Vincent J. Coughlin, Jr.

[57] ABSTRACT

An intensified charge-coupled image sensor comprises an image intensifier section and a header assembly. The header assembly includes a charge coupled device and an insulative header for retaining the charge-coupled device. An imaging aperture having a sidewall is formed in the insulative header. The imaging aperture is disposed about an optical axis of the image sensor. A conductive layer for preventing electrostatic charge buildup resulting from the impingement of photoelectrons emitted from a photoemissive cathode is provided on a first major surface of the header and on the sidewall bordering the imaging aperture. The header includes an electrode surface having a plurality of discrete contact pads thereon. A header input member has a substantially rectangular portion attached to a first major surface of the insulative header and an annular portion attached to the image intensifier section of the image sensor. A header output member has a substantially rectangular portion attached to a second major surface of the insulative header. The other end of the header output member is closed off by the end-closure cap.

5 Claims, 8 Drawing Figures

HEADER ASSEMBLY FOR AN INTENSIFIED CHARGE COUPLED IMAGE SENSOR

BACKGROUND OF THE INVENTION

The invention relates to a header assembly for an intensified charge coupled image sensor and, more particularly, to a rectangularly-shaped header assembly having oppositely disposed rows of electrical leads that can be connected to conventional electrical connectors.

An intensified charge coupled image sensor, as shown in FIG. 1, comprises an image intensifier tube having a photoemissive cathode on an interior surface of an input faceplate and a charge coupled device (CCD) located within an insulative header at the focal plane of the image intensifier tube. The CCD, shown in FIG. 2, includes an image array, known as an A register; a temporary storage array, known as a B register; and an output or C register. The operation of the CCD is described in U.S. Pat. No. 4,355,229 issued to Zimmerman et al. on Oct. 19, 1982. The insulative header, shown in FIGS. 1 and 3, comprises a ceramic plate having a central aperture, larger than the CCD, and a plurality of metallized contact pads disposed on one surface of the ceramic plate and extending from the central aperture to the sides of the plate. The CCD is mechanically attached by means of clips, for example, to a holder plate, such as that shown in FIG. 4, having an aperture therein for exposing the A register to photoelectrons from the photoemissive cathode. The holder plate is brazed to the top side of the insulative header. Electrical connections are made to the metallized contact pads by either of two alternative structures. In the first alternative structure, discrete leads are soldered to each of the contact pads. In the second alternative structure, customized electrical connectors contact the contact pads. Experience has shown that these alternative contact structures are expensive and unreliable. Accordingly, the need exists for a header assembly that can be electrically contacted by conventional, "off-the-shelf" electrical connectors in order to increase the electrical reliability of the sensor while reducing its cost.

SUMMARY OF THE INVENTION

An intensified charge-coupled image sensor, having a longitudinally extending optical axis, comprises an image intensifier section and a header assembly. The image intensifier section includes an envelope with a photoemissive cathode therein for emitting photoelectrons in a pattern corresponding to the intensity of radiation incident thereon. The header assembly includes a charge coupled device for receiving the photoelectrons from the cathode and an insulative header for retaining the charge-coupled device. A header input member is attached between the insulative header and the image intensifier section of the image sensor. Closure means closes the output end of the header assembly. Unlike prior art header assemblies, the present header assembly has an improved insulative header which includes a plurality of substantially rectangular insulative members joined in layers to form a hermetic, dimensionally stable, thermally inert structure. The header has a first major surface and an oppositely disposed second major surface. An imaging aperture, having a sidewall, is formed in the insulative header. The imaging aperture is disposed about the optical axis of the image sensor. Means for preventing electrostatic charge buildup resulting from the impingement of the photoelectrons emitted from the photoemissive cathode is provided on the first major surface of the header and on the sidewall bordering the imaging aperture. The header also includes an electrode surface having a plurality of discrete contact pads thereon. The contact pads are disposed between two of the insulative members and extend outwardly from the periphery.of the imaging aperture. Half of the contact pads are located at spaced intervals along one long side of the header, and the other half of the contact pads are located at spaced intervals along the other long side of the header. Each of the contact pads is connected to a different outwardly extending electrical lead attached to the header. The electrical leads are arranged in oppositely disposed rows. The header input member has a substantially rectangular portion attached to the first major surface of the insulative header and an annular portion attached to the image intensifier section of the image sensor. The closure means includes a header output member having a substantially rectangular portion attached to the second major surface of the insulative header. The other end of the header output member is closed off by an end-closure cap.

DETAILED DESCRIPTION OF THE PREFERRED EMBODIMENT

Figure 1:
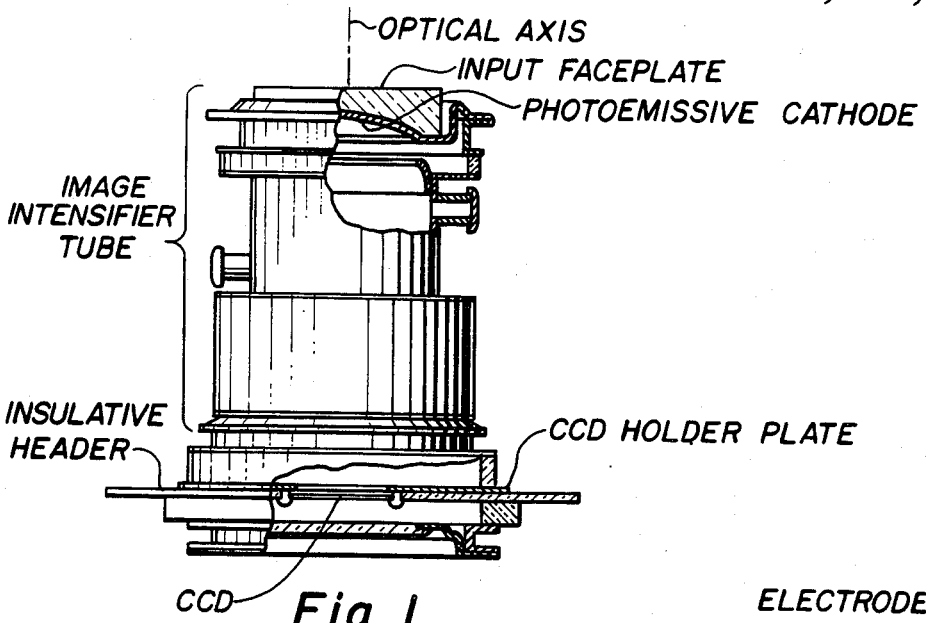
Fig. 1 PRIOR ART
FIG. 1 is an enlarged elevation view, partially in section, of a prior art intensified charge-coupled image sensor.
Figure 2:
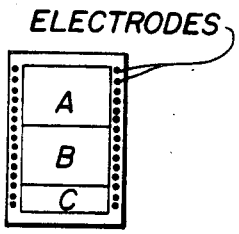
Fig. 2 PRIOR ART
FIG. 2 is a schematic representation of a CCD imager.
Figure 3:
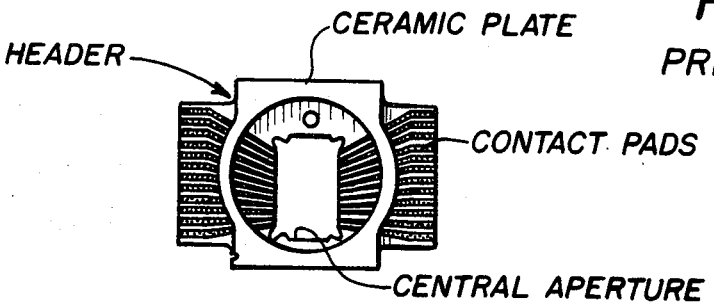
Fig. 3 PRIOR ART
FIG. 3 is a plan view of a prior art insulative header.
Figure 4:
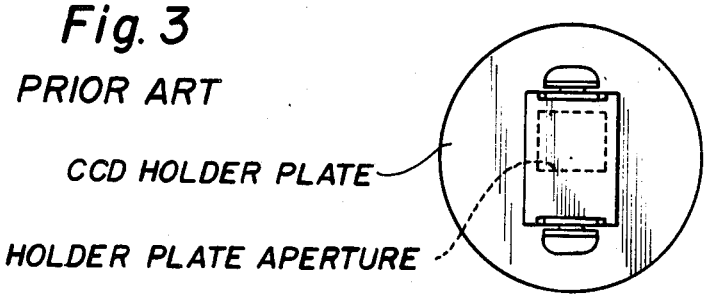
Fig. 4 PRIOR ART
FIG. 4 is a plan view of a prior art CCD holder plate.
Figure 5:
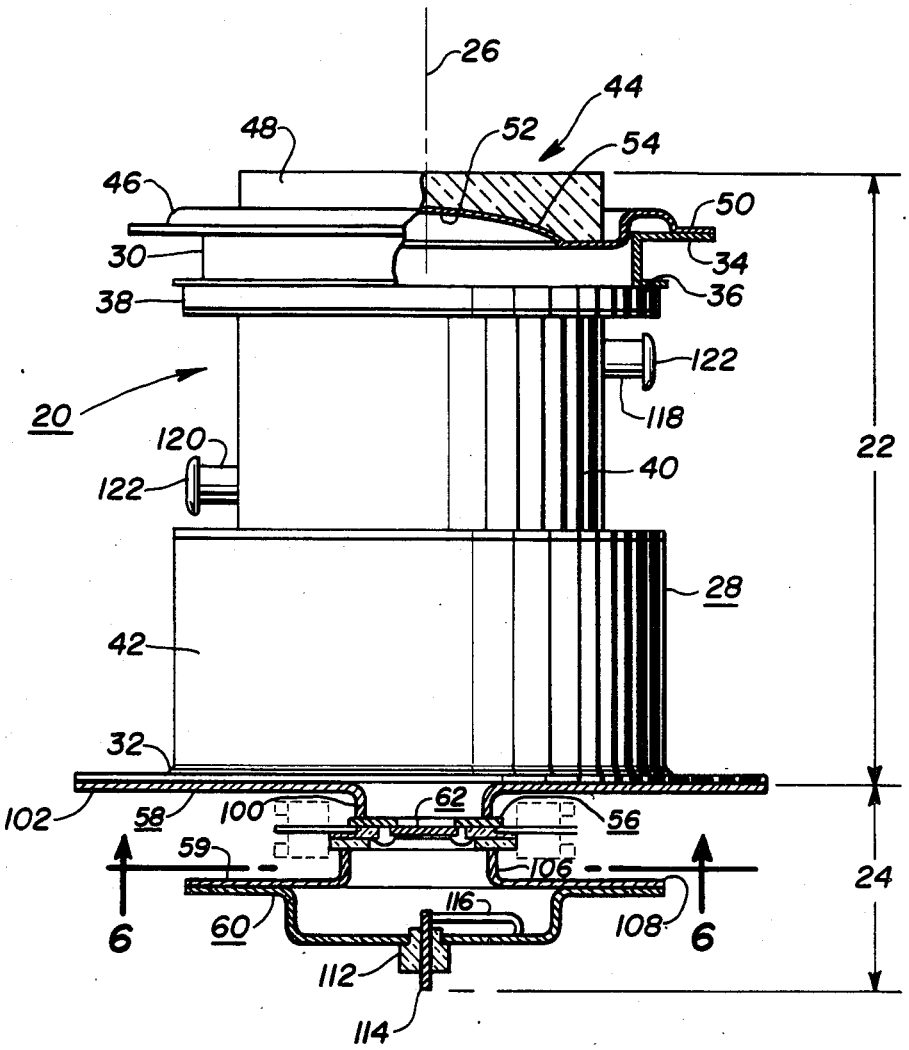
FIG. 5 is an enlarged elevation view, partially in section, of an intensified charge-coupled image sensor having a novel header assembly.

An intensified charge-coupled image sensor 20 is shown in FIG. 5. The image sensor 20 comprises an inverter image intensifier section 22 and a novel header assembly 24. An optical axis 26 extends longitudinally along the center line of the sensor 20.

The image intensifier section 22 comprises a substantially cylindrical vacuum envelope 28 which may be of glass-metal or ceramic-metal construction. For maintaining close dimensional tolerances, ceramic-metal construction is preferred. The envelope 28 includes a conductive annular envelope input flange 30 at one end and a conductive annular envelope header flange 32 at the other end. The envelope input flange 30 has a substantially flat, radially extending weld lip 34 and an oppositely disposed sealing surface 36. A cylindrical insulating spacer 38, preferably of a high alumina ceramic material, is attached, for example by brazing, to the sealing surface 36 of the envelope input flange 30. The opposite end of the insulating spacer 38 similarly is attached to one end of a grid bulb flange 40. An anode insulating spacer 42, also formed from a high alumina ceramic material, is attached, for example by brazing, between the other end of the grid bulb flange 40 and the envelope header flange 32.

An input faceplate assembly 44 closes one end of the envelope 28. The input faceplate assembly 44 includes a cathode faceplate flange 46 and a cathode faceplate 48. The cathode faceplate 48 preferably comprises a fiber optic member, as is known in the art, that is frit sealed by conventional means to the cathode faceplate flange 46. The cathode faceplate flange 46 includes a radially extending portion 50, which is welded around its periphery to the weld lip 34 of the envelope input flange 30. A photoemissive cathode 52 is formed on an interior surface 54 of the cathode faceplate 48. The cathode emits photoelectrons (not shown) in a pattern corresponding to the intensity of the radiation incident thereon. As herein described, the image intensifier section 22 is conventional. A more complete description of the image intensifier section is contained in U.S. Pat. No. 4,355,229 issued to Zimmerman et al. which is incorporated by reference herein for the purpose of disclosure.

The novel header assembly 24 comprises, in combination, an insulative header 56, a header input member 58, a header output member 59, a disc-shaped end-closure cap 60 and a charge-coupled device assembly 62 for receiving the photoelectrons from the photoemissive cathode 52. The charge-coupled device assembly 62 includes a charge-coupled device (CCD) 64 having an A register, a B register and a C register, and a support frame member 66 (shown in FIGS. 7 and 8) attached to the periphery of one surface of the CCD 64. Such a structure is described in U.S. Pat. No. 4,604,519 issued to Zollman which is incorporated by reference herein for the purpose of disclosure.

Figure 6:
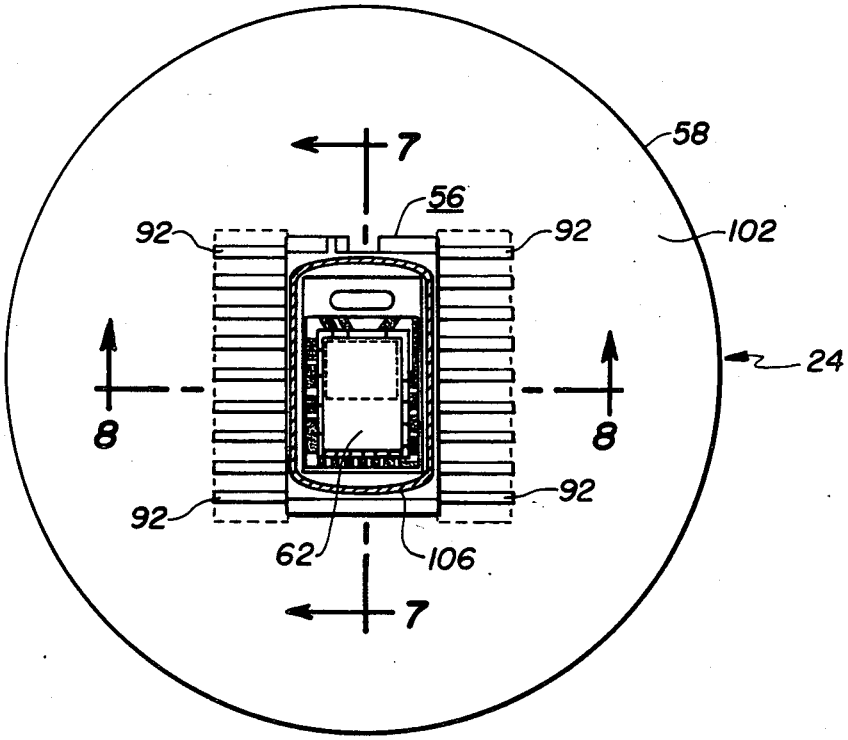
FIG. 6 is a plan view of the underside of the novel header assembly taken along line 6—6 of FIG. 5.
Figure 7:
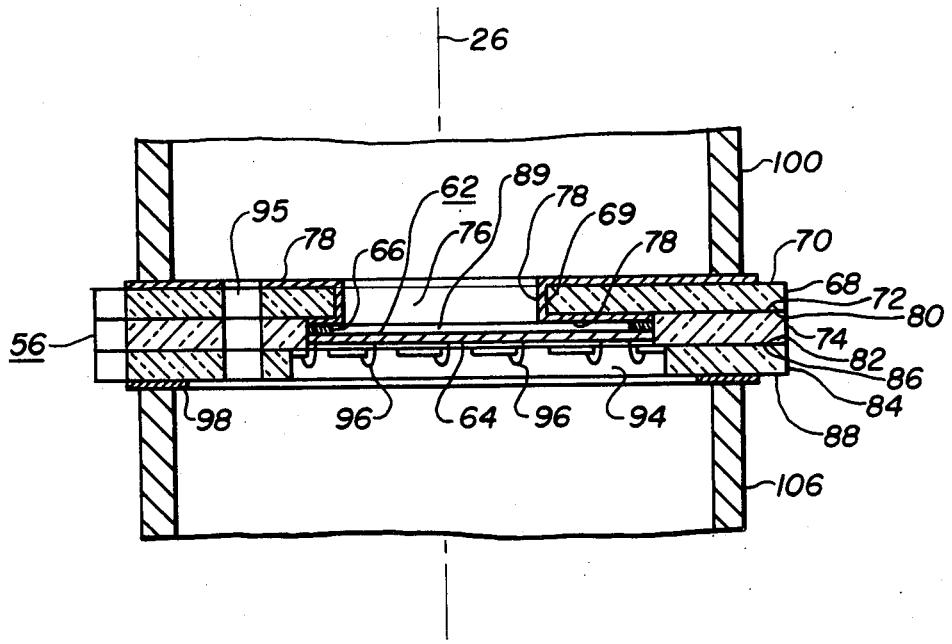
FIG. 7 is a section view taken along lines 7—7 of FIG. 6.
Figure 8:
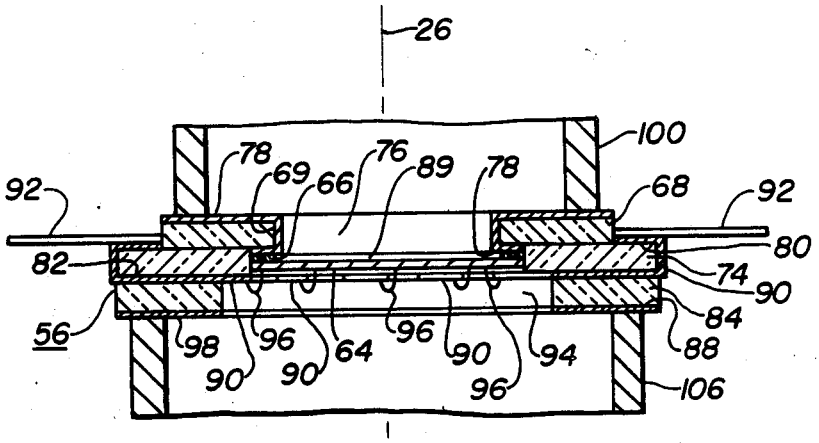
FIG. 8 is a section view taken along lines 8—8 of FIG. 6.

FIG. 6 shows a plan view of the underside of the novel header assembly 24. The insulative header 56 is shown in detail in FIGS. 7 and 8. The insulative header 56 includes a plurality of substantially rectangular insulative members formed, e.g., of high alumina ceramic, joined together in layers by a lamination and sintering process that provides a strong, hermetic, dimensionally stable and thermally inert header. The process is known in the art and need not be described in detail. Alternatively, the header 56 may be formed of a plurality of ceramic components that are bonded together by a suitable medium. As shown in FIGS. 7 and 8, the header 56 comprises a substantially flat, rectangular first ceramic member 68 having a first surface 70 which is designated as the first major surface of the header 56, and an opposed flat contact surface 72 which is joined to a substantially flat rectangular second ceramic member 74. A substantially rectangular imaging aperture 76, smaller than the CCD 64, is formed through the first ceramic member 68. The imaging aperture 76 is centered about the optical axis 26 of the image sensor 20 and is bordered by a vertical sidewall 69 of the first ceramic member 68. The first major surface 70 of the header 56 is metallized by a method described in U.S. Pat. No. 3,290,171 issued to Zollman et al. on Dec. 6, 1966 and incorporated by reference herein for the purpose of disclosure. The metallizing forms a conductive layer 78 which extends along the vertical sidewall 69 bordering the imaging aperture 76 and also along a portion of the opposed contact surface 72. The second ceramic member 74 has a first surface 80 affixed to the second contact surface 72 of the first ceramic member 68 and an oppositely disposed second surface 82 which is designated as the electrode surface of the header 56 and which is adjacent to a substantially flat, rectangular third ceramic member 84 having a first surface 86 and a second surface 88, which is designated as the second major surface of the header 56. The second ceramic member 74 has a rectangularly-shaped opening 89 formed therein which communicates with the imaging aperture 76 in the first ceramic member 68. The rectangular opening 89 is configured to accommodate the charge-coupled device assembly 62. The support frame 66 of the assembly 62 is affixed, for example by brazing, to the exposed, metallized portion 78 of the second contact surface 72 of the first ceramic member 68. The second ceramic member 74 has a length substantial equal to that of the first ceramic member 68 and a width somewhat greater than that of the first ceramic member. As shown in FIG. 8, the greater width of the second ceramic member 74 provides a lead sealing portion along the exposed portion of the first surface 80 of the second ceramic member 74. A plurality of discrete contact pads 90 are formed on the electrode surface 82 of the second ceramic member 74 and extend outwardly so that half of the contact pads 90 are disposed at spaced intervals along one long side of the second ceramic member 74 and the other half of the contact pads 90 are disposed at spaced intervals along the other long side of the second ceramic member. The pads 90 also extend longitudinally along the edge of the second ceramic member 74 and onto the lead sealing portion of the first surface 80 of the second ceramic member 74. The outward end of each of the contact pads 90 is connected, for example by brazing, to a different outwardly extending electrical lead 92 disposed on the lead sealing portion of the first surface 80. The leads are arranged in oppositely disposed rows and lie in a plane that is transverse to the optical axis 26. The novel header 56 with its lead configuration permits the use of conventional electrical connectors such as the AMP 583773-2 or 583774-2 type connectors available from Amp. Inc., Harrisburg, Pa. and shown in phantom in FIGS. 5 and 6. Prior image sensors utilized non-conventional header structures and lead configurations which required either expensive customized electrical connectors or direct attachment to the metallized contact pads.

The third ceramic member 84 is identical in external dimensions to the second ceramic member 74; however, the third ceramic member 84 has a rectangularly-shaped opening 94 that is larger than the opening 89 in the second ceramic member 74. A pressure relief aperture 95, shown in FIG. 7, is formed through the first, second and third ceramic members 68, 74 and 84, respectively. The charge-coupled device assembly is disposed within the openings 89 and 94 with the frame member 66 attached to the metallizing 78 which extends onto the opposed flat contact surface 72 of the first ceramic member 68. The charge-coupled device assembly 62 is located so that the A register of the CCD 64 is framed by the imaging aperture 76 of the first ceramic member 68 to permit photoelectrons (not shown) from the photoemissive cathode 52 to impinge thereon, while the unapertured portion of the first ceramic member 68 shields the B register and the C register of the CCD 64 from the photoelectrons. The metallized layer 78 disposed on the first major surface 70 and along the vertical sidewall 69 of the first ceramic member 68 bordering the imaging aperture 76 prevents an electrostatic charge buildup on the first ceramic member caused by the impingement of stray photoelectrons by providing a conductive path for charge dissipation. Without this novel charge dissipating structure the operation of the CCD 64 would be degraded by an increase in background noise. The larger opening 94 in the third ceramic member 84 provides sufficient space to facilitate bonding of the CCD electrodes (not shown) to the contact pads 90 formed on the second surface 82 of the second ceramic member 74. Bonding wires 96 (only some of which are shown) provide the electrical connection between the CCD electrodes and the contact pads 90. A metallized layer 98, is provided around the outer perimeter of the second major surface 88 of the header 56. The metallized layer 98 is electrically insulated from the metallized layer 78 formed on the first major surface 70 and along the vertical sidewall 69.

With reference to FIGS. 5, 7 and 8, the header input member 58 includes a substantially rectangular header input sealing portion 100 which is attached, for example by brazing, to the metallized layer 78 on the first major surface 70 of the header 56. An annular input flange portion 102 of the input member 58 is attached, for example by heliarc welding, to the annular envelope header flange 32. 5 As shown in FIG. 5, the header output member 59 has a substantially rectangular header output sealing portion 106 which is attached, for example by brazing, to the metallized layer 98 on the outer perimeter of the second major surface 88 of the header 56. An annular output flange portion 108 is attached, for example by heliarc welding, to the disc-shaped end-closure cap 60. A ceramic insulator 112 having a conductive lead 114 brazed therethrough is provided in the end-closure cap 60. A getter 116, such as barium or titanium is attached between the lead 114 and the end-closure cap 60.

The photoemissive cathode 52 may be one of any number of photoemissive surfaces known in the art. For many applications where extended red response is desirable, a potassium-sodium-cesium-antimony photoemissive cathode is preferred. Briefly, the cathode is formed by baking the image sensor 20 at an elevated temperature for several hours with a copper exhaust tubulation 118 connected to an exhaust system (not shown) for removing occluded gases from the sensor components. The pressure relief aperture 95 allows the pressure to be equalized on both sides of the CCD 64, thereby preventing damage to the CCD. The tube is then cooled to room temperature at which time the cathode formation and activation process is initiated. The process may, for example, be similar to that described in U.S. Pat. No. 3,658,400 issued to F. A. Helvy on Apr. 25, 1972, and entitled, "Method of Making A Multialkali Photocathode With Improved Sensitivity To Infrared Light And A Photocathode Made Thereby". The Helvy patent, assigned to assignee of the present invention, is incorporated by reference herein for the purpose of disclosure. The constituents of the photoemissive cathode 52 are introduced into the sensor 20 through a second copper tubulation 120. Each of the tubulations 118 and 120 is shown as being "tipped-off", i.e. cold welded, and covered by a protective cap 122.

What is claimed is:

1. In an intensified charge-coupled image sensor having a longitudinally extending optical axis, said image sensor comprising an image intensifier section including an envelope having therein a photoemissive cathode for emitting photoelectrons in a pattern corresponding to the intensity of radiation incident thereon, and a header assembly including a charge-coupled device for receiving the photoelectrons from said cathode, an insulative header for retaining said charge-coupled device, a header input member attached between said insulative header and said image intensifier section, and closure means for closing the output end of said header assembly, wherein the improvement comprises said insulative header including a plurality of substantially rectangular insulative members joined together in layers to form a hermetic, dimensionally stable, thermally inert structure, said header having a first major surface and an oppositely disposed second major surface, an imaging aperture formed in the header and having a sidewall, the imaging aperture being disposed about the optical axis of the image sensor, means for preventing electrostatic charge buildup on the first major surface of the header and on the sidewall bordering the imaging aperture, an electrode surface having a plurality of discrete electrode pads disposed between two of the insulative members of the header, the electrode pads extending outwardly from the periphery of the imaging aperture, half of the contact pads being located at spaced intervals along one long side of the header and the other half of the contact pads being located at spaced intervals along the other long side of the header, each of the contact pads being connected to a different outwardly extending electrical lead, the electrical leads being arranged in oppositely disposed rows, the header input member having a substantially rectangular portion attached to the first major surface of the header and an annular portion attached to the image intensifier section of the image sensor, and the closure means including a header output member having a substantially rectangular portion attached to the second major surface of the header and an end portion closed by an end-closure cap.

2. The intensified charge-coupled image sensor as described in claim 1, wherein each of the electrical leads is disposed in a plane that is transverse to the optical axis of the image sensor.

3. The intensified charge-coupled image sensor as described in claim 1, wherein a portion of the charge coupled device is framed by the imaging aperture in the insulative header.

4. The intensified charge-coupled image sensor as described in claim 1, wherein the means for preventing electrostatic charge build-up comprises a first conductive layer.

5. In an intensified charge-coupled image sensor having a longitudinally extending optical axis, said image sensor comprising an image intensifier section including an envelope having therein a photoemissive cathode for emitting photoelectrons in a pattern corresponding to the intensity of radiation incident thereon, and a header assembly including a charge-coupled device for receiving the photoelectrons from said cathode, an insulative header for retaining said charge-coupled device, a header input member attached between said insulative header and said image intensifier section, and closure means for closing the output end of said header assembly, wherein the improvement comprises said insulative header including a plurality of substantially rectangular insulative members joined together in layers to form a hermetic, dimensionally stable, thermally inert structure, said header having a first major surface, an oppositely disposed second major surface, an imaging aperture formed in the insulative header and having a sidewall, the imaging aperture being disposed about the optical axis of the image sensor and being smaller than the charge-coupled device, the first major surface of the header and the sidewall bordering the imaging aperture having a first conductive layer thereon, the second major surface having a second conductive layer thereon, the first and second conductive layers being insulated from each other, the header including an electrode surface having a plurality of discrete electrode pads thereon, the electrode pads being disposed between two of the insulative members, the electrode pads extending outwardly from the periphery of the imaging aperture, half of the pads being located at spaced intervals along one long side of the header and the other half of the outwardly extending contact pads being located at spaced intervals along the other long side of the header, each of the contact pads being connected at its outward end to a different electrical lead, the electrical leads being arranged in oppositely disposed rows and lying in a plane that is transverse to the optical axis of the image sensor, said header input member having a substantially rectangular portion attached to the first conductive layer on the first major surface of the header and an annular portion attached to the image intensifier section of the image sensor, and the closure means including a header output member having a substantially rectangular portion attached to second conductive layer on the second major surface of the header and an annular portion attached to an end closure cap.

* * * * *